US010100665B2

(12) United States Patent
Hogen et al.

(10) Patent No.: US 10,100,665 B2
(45) Date of Patent: Oct. 16, 2018

(54) METHOD FOR HEATING UP A STEAM TURBINE OR FOR KEEPING A STEAM TURBINE HOT

(71) Applicant: Siemens Aktiengesellschaft, Munich (DE)

(72) Inventors: Tobias Hogen, Essen (DE); Yevgen Kostenko, Ratingen (DE); Sebastian Zahn, Duisburg (DE); Uwe Zander, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/312,930

(22) PCT Filed: Apr. 29, 2015

(86) PCT No.: PCT/EP2015/059276
§ 371 (c)(1),
(2) Date: Nov. 21, 2016

(87) PCT Pub. No.: WO2015/185292
PCT Pub. Date: Dec. 10, 2015

(65) Prior Publication Data

US 2017/0204741 A1 Jul. 20, 2017

(30) Foreign Application Priority Data

Jun. 4, 2014 (EP) ..... 14171101

(51) Int. Cl.
*F01K 13/00* (2006.01)
*F01D 25/10* (2006.01)
(Continued)

(52) U.S. Cl.
CPC ..... *F01D 25/10* (2013.01); *F01K 7/16* (2013.01); *F01K 13/02* (2013.01); *F05D 2220/31* (2013.01); *F05D 2220/74* (2013.01)

(58) Field of Classification Search
CPC ..... F01D 25/10; F01K 13/02
(Continued)

(56) References Cited

U.S. PATENT DOCUMENTS 6,223,518 B1 5/2001 Wada et al.
6,405,537 B1 6/2002 Wada et al.
(Continued)

FOREIGN PATENT DOCUMENTS

DE 607273 A 12/1934
DE 102010042405 A1 4/2012
(Continued)

OTHER PUBLICATIONS

EP Search Report dated Feb. 19, 2015, for EP application No. 14171101.0.
(Continued)

*Primary Examiner* — Jason Shanske
(74) *Attorney, Agent, or Firm* — Beusse Wolter Sanks & Maire

(57) ABSTRACT

A method for heating up a steam turbine or for keeping a steam turbine hot, which steam turbine has at least one pressure stage working at an initial pressure or intermediate pressure, at least one final pressure stage which is fluidically connected downstream of the pressure stage and works at a final pressure which is lower than the initial pressure or intermediate pressure, and at least one condenser which is connected downstream of the final pressure stage, wherein steam generated outside the steam turbine is introduced into
(Continued)

the pressure stage. After flowing through the pressure stage and bypassing the final pressure stage, the steam is supplied directly to the condenser.

9 Claims, 1 Drawing Sheet

(51) Int. Cl.
*F01K 13/02* (2006.01)
*F01K 7/16* (2006.01)

(58) Field of Classification Search
USPC ..... 60/645
See application file for complete search history.

(56) References Cited

U.S. PATENT DOCUMENTS

| | | | | |
|---|---|---|---|---|
| 8,991,180 | B2 | 3/2015 | Rewers et al. | |
| 2004/0013511 | A1* | 1/2004 | Brackenhammer | F01K 7/22 415/1 |
| 2008/0210089 | A1* | 9/2008 | Tsangaris | C10J 3/00 95/90 |
| 2010/0293948 | A1* | 11/2010 | Berke | F01K 13/02 60/645 |
| 2012/0227372 | A1* | 9/2012 | Li | F01K 7/38 60/39.182 |

FOREIGN PATENT DOCUMENTS

| | | | |
|---|---|---|---|
| EP | 1191192 | A1 | 3/2002 |
| JP | S59192806 | A | 11/1984 |
| JP | S60164606 | A | 8/1985 |
| JP | S62159705 | A | 7/1987 |
| JP | S62237010 | A | 10/1987 |
| JP | S63297705 | A | 12/1988 |
| SU | 1506154 | A1 | 9/1989 |
| WO | 9749903 | A1 | 12/1997 |
| WO | 97049903 | A1 | 12/1997 |

OTHER PUBLICATIONS

International Search Report dated Jul. 22, 2015, for PCT application No. PCT/EP2015/059276.

RU Notice of Allowance dated Feb. 7, 2018, for RU patent application No. 2016150530.

JP Office Action dated Dec. 25, 2017, for JP patent application No. 2016-571126.

JP notice of allowance dated Apr. 9, 2018, for JP patent application No. 2016571126.

* cited by examiner

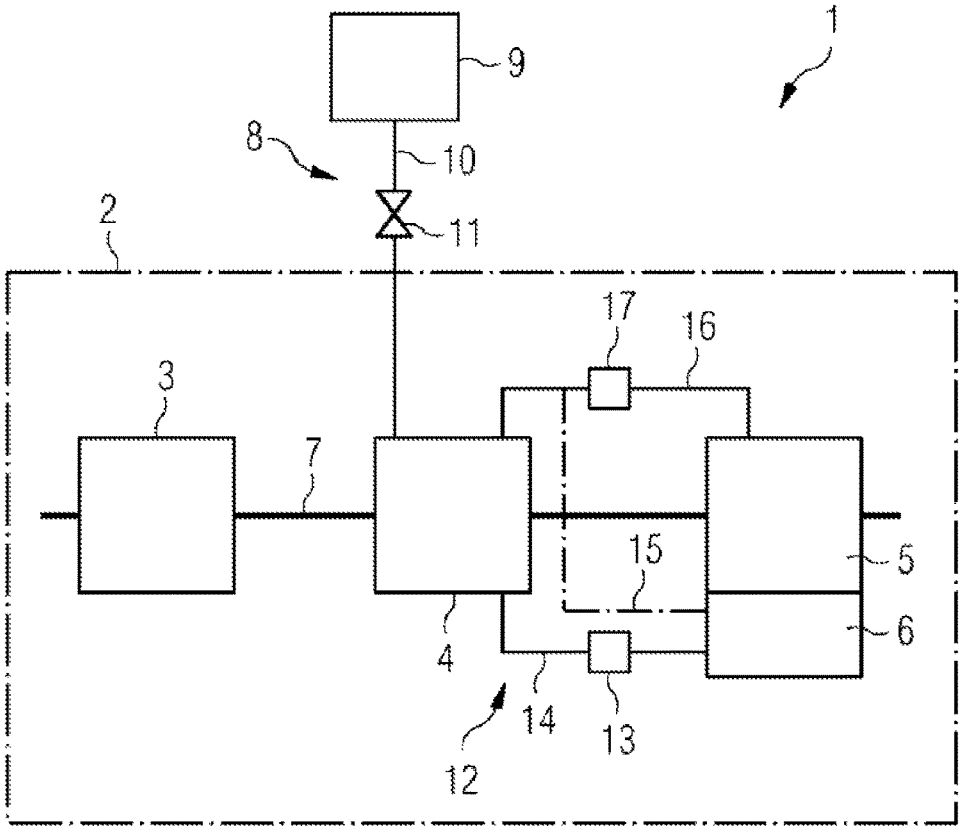
1
9
8
10
11
2
17
16
3
7
15
5
6
4
14
13
12

METHOD FOR HEATING UP A STEAM TURBINE OR FOR KEEPING A STEAM TURBINE HOT

CROSS REFERENCE TO RELATED APPLICATIONS

This application is the U.S. National Stage of International Application No. PCT/EP2015/059276 filed Apr. 29, 2015, and claims the benefit thereof. The International Application claims the benefit of European Application No. EP14171101 filed Jun. 4, 2014. All of the applications are incorporated by reference herein in their entirety.

FIELD OF INVENTION

The invention relates to a method for heating up a steam turbine or for keeping a steam turbine hot, which steam turbine has at least one pressure stage which operates at an initial or intermediate pressure level, at least one final pressure stage which operates at a final pressure level which is lower than the initial or intermediate pressure level and is fluidically connected downstream of the pressure stage, and at least one condenser which is connected downstream of the final pressure stage, steam which is generated outside the steam turbine being introduced into the pressure stage.

Furthermore, the invention relates to a system for heating up a steam turbine or for keeping a steam turbine hot, which steam turbine has at least one pressure stage which operates at an initial or intermediate pressure level, at least one final pressure stage which operates at a final pressure level which is lower than the initial or intermediate pressure level and is fluidically connected downstream of the pressure stage, and at least one condenser which is connected downstream of the final pressure stage.

Furthermore, the invention relates to a power plant, in particular a combined gas/steam turbine power plant or a steam power plant, with at least one steam turbine.

BACKGROUND OF INVENTION

As, for example, DE 607 273 A discloses, it is known that components of a two-stage or multiple-stage steam turbine have to be heated up before the operation of the steam turbine or have to be kept hot in an intermediate mode of the steam turbine, in order to avoid damage of the steam turbine. Utilization of heating-up and keeping-warm concepts which are provided for this purpose makes short start-up times possible of a power plant which comprises a steam turbine, which is associated with enormous advantages for plant constructors and plant operators.

Components of a steam turbine can be kept warm by feeding externally generated steam, for example auxiliary steam, sealing steam or the like, to the components of the steam turbine. Typical temperatures of the steam which is used here can be from approximately 250° C. to approximately 300° C. The steam can be introduced, for example, into a middle pressure stage of a multiple-stage steam turbine, it being possible for the steam to expand in the direction of a low pressure stage of the steam turbine, which low pressure stage is connected downstream of the middle pressure stage.

The components of a low pressure stage of a steam turbine are usually not designed for outflow temperatures of 300° C. Therefore, in the case of an introduction of steam which is used for heating up a steam turbine or keeping a steam turbine hot into the low pressure stage, significant limitations can be produced for the components of the low pressure stage which can shorten the service life of the low pressure stage substantially. In order to avoid this, the components of a low pressure stage can be cooled during heating up of a steam turbine or keeping a steam turbine hot, for example by means of water injection (what is known as housing spraying) and/or by means of two-phase injection. However, this is associated with additional costs for the cooling.

SUMMARY OF INVENTION

It is an object of the invention to make it possible to heat up a steam turbine or keep a steam turbine hot with relatively low costs.

In accordance with the method according to the invention for heating up a steam turbine or for keeping a steam turbine hot, which steam turbine has at least one pressure stage which operates at an initial or intermediate pressure level, at least one final pressure stage which operates at a final pressure level which is lower than the initial or intermediate pressure level and is fluidically connected downstream of the pressure stage, and at least one condenser which is connected downstream of the final pressure stage, steam which is generated outside the steam turbine is introduced into the pressure stage, and the steam is fed directly to the condenser after flowing through the pressure stage and bypassing the final pressure stage.

In accordance with the invention, the steam which is introduced into the steam turbine or its pressure stage is not conducted through the final pressure stage. As a result, boundary conditions of the components of the final pressure stage which correspond to the design of the low pressure stage are maintained when heating up the steam turbine or keeping the steam turbine hot. Since the components of the final pressure stage are not loaded with the steam and/or the associated high temperatures, the service life of the components of the final pressure stage is not impaired. In addition, cooling of the components of the final pressure stage does not have to take place, as described above and conventionally necessary, with the result that heating up of the steam turbine or keeping the steam turbine hot can take place less expensively using the method according to the invention, in particular since no cooling system has to be used. As a result of the bypassing according to the invention of the final pressure stage, the final pressure stage is decoupled fluidically from the pressure stage during heating up of the steam turbine or keeping the steam turbine hot.

The pressure stage can be a middle pressure stage of a three-stage steam turbine, in which the steam is introduced directly into the middle pressure stage of the steam turbine, or in which the steam is introduced into a high pressure stage of the steam turbine which is connected upstream of the middle pressure stage and is conducted from there into the middle pressure stage. Here, the final pressure stage can be configured as a low pressure stage of the steam turbine. As an alternative, the pressure stage can be a high pressure stage of a two-stage steam turbine, and the final pressure stage can be a low pressure stage of the steam turbine which is connected downstream of the high pressure stage.

In the condenser which is connected downstream of the final pressure stage, a liquid which is contained in the steam can be condensed and can be fed to a liquid circuit, in order for it to be possible to use it again for the generation of steam. As an alternative, the condensed liquid can be used or discharged in some other way.

The method according to the invention can be used for heating up a steam turbine or keeping a steam turbine hot of a steam power plant or a combined gas/steam turbine power plant.

After flowing through the pressure stage, the steam is extracted from the pressure stage by means of vacuum. This represents a simple and effective option for discharging the steam from the pressure stage. In order to extract the steam from the pressure stage, a vacuum connector can be arranged on the pressure stage, which vacuum connector is connected in a fluid-conducting manner to the condenser. As an alternative, a vacuum connector can be arranged on a crossflow line between the pressure stage and the final pressure stage or on a steam inlet line which opens into the final pressure stage. The vacuum can be generated and set by way of a suitable means which is actuated or activated correspondingly to this end during heating up of the steam turbine or keeping the steam turbine hot.

The steam is advantageously extracted from the pressure stage by means of at least one fan. Here, a suction side of the fan faces the pressure stage, whereas a pressure side of the fan faces the condenser.

A throttle flap which is arranged in a crossflow line between the pressure stage and the final pressure stage is advantageously closed during the introduction of the steam into the pressure stage. This can prevent the steam from passing into the final pressure stage. In addition, the efficiency of an extraction of the steam from the pressure stage is increased, since a return flow of fluid from the final pressure stage is suppressed during the extraction of the steam.

The system according to the invention for heating up a steam turbine or for keeping a steam turbine hot, which steam turbine has at least one pressure stage which operates at an initial or intermediate pressure level, at least one final pressure stage which operates at a final pressure level which is lower than the initial or intermediate pressure level and is fluidically connected downstream of the pressure stage, and at least one condenser which is connected downstream of the final pressure stage, comprises: at least one device for generating steam and for introducing the steam into the pressure stage; at least one apparatus for discharging the steam, after flowing through the pressure stage, from the pressure stage and for directly feeding the steam which is discharged from the pressure stage to the condenser bypassing the final pressure stage.

The advantages and embodiments which were mentioned above in relation to the method are associated correspondingly with the system. The device can be set up for generating auxiliary steam, sealing steam or the like.

The apparatus has at least one means for extracting the steam from the pressure stage. The means can be, for example, a blower or fan.

The system advantageously comprises at least one shut-off device which is formed by way of a throttle flap which is arranged in a crossflow line between the pressure stage and the final pressure stage, which shut-off device can be closed during the introduction of the steam into the pressure stage. The system can have an electronic controller for actuating the device, the apparatus and the shut-off device, which electronic controller controls said components of the system as described above.

The power plant according to the invention, in particular the combined gas/steam turbine power plant or the steam power plant, comprises at least one steam turbine and at least one system in accordance with one of the abovementioned refinements or any desired combination thereof. The advantages which were mentioned above in relation to the system and/or the method are associated correspondingly with the power plant.

In the following text, one embodiment of the system according to the invention will be explained using the appended diagrammatic drawing.

BRIEF DESCRIPTION OF THE DRAWINGS

In the drawing: the sole FIGURE shows a diagrammatic illustration of one exemplary embodiment for a system according to the invention.

DETAILED DESCRIPTION OF INVENTION

The FIGURE shows a diagrammatic illustration of one exemplary embodiment for a system 1 according to the invention for heating up a three-stage steam turbine 2 or for keeping a three-stage steam turbine 2 hot, which steam turbine 2 has a high pressure stage 3 which operates at an initial pressure level or high pressure level, a pressure stage 4 or middle pressure stage which operates at an intermediate pressure level or middle pressure level, a final pressure stage 5 which operates at a final pressure level or low pressure level and is fluidically connected downstream of the pressure stage 4, and a condenser 6 which is connected downstream of the final pressure stage 5. The high pressure stage 3, the pressure stage 4 and the final pressure stage 5 are coupled mechanically via a common rotor shaft 7.

The system 1 comprises a device 8 for generating steam and for introducing the steam into the pressure stage 4 or middle pressure stage. To this end, the device 8 has a steam generation unit 9 which generates the steam as a main product or auxiliary product. Furthermore, the device 8 comprises a feed line 10 which opens into the pressure stage 4 and in which an electrically actuable valve 11 is arranged which is opened for heating up the steam turbine 2 or for keeping the steam turbine 2 hot.

Furthermore, the system 1 comprises an apparatus 12 for discharging the steam, after flowing through the pressure stage 4 or middle pressure stage, from the pressure stage 4 and for feeding the steam which is discharged from the pressure stage 4 directly to the condenser 6 bypassing the final pressure stage 5 or low pressure stage. In order to discharge the steam from the pressure stage 4, the apparatus 12 comprises a means 13 in the form of a fan for extracting the steam from the pressure stage 4, which means 13 is arranged in an extraction line 14 of the apparatus 12. The extraction line 14 directly follows the pressure stage 4. As an alternative to the extraction line 14, an extraction line 15 which is shown using dash-dotted lines can be present, which extraction line 15 connects a crossflow line 16 between the pressure stage 4 and the final pressure stage 5 to the condenser 6 in a fluid-conducting manner. A shut-off device 17 which is formed by way of a throttle valve and is closed during the introduction of the steam into the pressure stage 4 is arranged on the crossflow line 16.

Although the invention has been illustrated and described relatively closely in detail by way of the preferred exemplary embodiment, the invention is not restricted by the disclosed example and other variations can be derived herefrom by a person skilled in the art, without departing from the scope of protection of the invention.

The invention claimed is:

1. A method for heating up a steam turbine or for keeping a steam turbine hot, which steam turbine comprises at least one pressure stage which operates at an initial or intermediate pressure level, at least one final pressure stage which operates at a final pressure level which is lower than the initial or intermediate pressure level and is fluidically connected downstream of the at least one pressure stage, and at least one condenser which is connected downstream of the at least one final pressure stage, the method comprising:

introducing steam which is generated outside the steam turbine into the at least one pressure stage, feeding the steam directly to the at least one condenser after the steam flows through the at least one pressure stage, thereby bypassing the at least one final pressure stage, generating a vacuum on an inlet side of an extractor disposed in a discharge line between an outlet of the at least one pressure stage and an inlet of the extractor, and extracting the steam from the at least one pressure stage by means of the vacuum.

2. The method as claimed in claim 1, wherein the extractor comprises at least one fan.

3. The method as claimed in claim 1, further comprising:

closing a throttle flap which is arranged in a crossflow line between the at least one pressure stage and the at least one final pressure stage during the introduction of the steam into the at least one pressure stage.

4. A system for heating up a steam turbine or for keeping a steam turbine hot, which steam turbine comprises at least one pressure stage which operates at an initial or intermediate pressure level, at least one final pressure stage which operates at a final pressure level which is lower than the initial or intermediate pressure level and is fluidically connected downstream of the at least one pressure stage, and at least one condenser which is connected downstream of the at least one final pressure stage, the system comprising:

a steam generator configured to introduce steam into the at least one pressure stage;

a discharge line configured to discharge the steam from the at least one pressure stage and to directly feed the steam which is discharged from the at least one pressure stage to the at least one condenser, thereby bypassing the at least one final pressure stage, and an extractor fluidically connected to the discharge line and configured to generate a vacuum in the discharge line on an inlet side of the extractor to extract the steam from the at least one pressure stage.

5. The system as claimed in claim 4, further comprising:

at least one shut-off device which is formed by way of a throttle flap which is arranged in a crossflow line between the at least one pressure stage and the at least one final pressure stage, which shut-off device is closeable during the introduction of the steam into the at least one pressure stage.

6. A power plant or a combined gas/steam turbine power plant or a steam power plant, comprising:

at least one steam turbine, comprising at least one system as claimed in claim 4.

7. A system for heating up a steam turbine or for keeping a steam turbine hot, which steam turbine comprises a high-pressure stage, an intermediate-pressure stage, and a low-pressure stage, and a condenser connected downstream of the low-pressure stage, the system comprising:

a steam generator configured to introduce steam into the intermediate-pressure stage;

a discharge line configured receive the steam from the intermediate-pressure stage and to directly feed the steam to the condenser, thereby bypassing the low-pressure stage, and an extractor fluidically connected to the discharge line and configured to generate a vacuum in the discharge line on an inlet side of the extractor to extract the steam from the intermediate-pressure stage.

8. The system of claim 7, wherein the extractor comprises a fan.

9. The system of claim 7, further comprising:

a crossflow line between the intermediate-pressure stage and the low-pressure stage, and a shut-off device arranged in the crossflow line between the intermediate-pressure stage and the low-pressure stage, which shut-off device is closeable during the introduction of the steam into the intermediate-pressure stage.

* * * * *